US011999550B2

(12) United States Patent
Pifer

(10) Patent No.: US 11,999,550 B2
(45) Date of Patent: Jun. 4, 2024

(54) CASE INSERT TO SECURE WOODWIND REEDS

(71) Applicant: Jennifer Pifer, Valdosta, GA (US)

(72) Inventor: Jennifer Pifer, Valdosta, GA (US)

( * ) Notice: Subject to any disclaimer, the term of this patent is extended or adjusted under 35 U.S.C. 154(b) by 0 days.

(21) Appl. No.: 17/680,110

(22) Filed: Feb. 24, 2022

(65) Prior Publication Data

US 2023/0264881 A1 Aug. 24, 2023

(51) Int. Cl.
*A45C 11/00* (2006.01)
*B65D 25/10* (2006.01)
*B65D 81/05* (2006.01)

(52) U.S. Cl.
CPC ..... *B65D 81/055* (2013.01); *B65D 25/107* (2013.01); *B65D 2581/051* (2013.01)

(58) Field of Classification Search
CPC ..... B65D 25/107; B65D 73/0078; B65D 73/0092; A45C 13/02
USPC ..... 206/214, 314, 385, 562
See application file for complete search history.

(56) References Cited

U.S. PATENT DOCUMENTS 1,803,028 A * 4/1931 Menten ..... B65D 5/5021 206/485
3,410,391 A * 11/1968 Kanter ..... B65D 25/02 221/293
4,450,965 A * 5/1984 Paillet ..... B65D 5/504 206/443
5,344,019 A * 9/1994 Van Hest ..... B65D 5/504 206/419
5,597,070 A * 1/1997 Wu ..... B65D 5/504 206/419
5,829,587 A * 11/1998 Saiki ..... B65D 5/54 206/327
D873,676 S * 1/2020 Weston ..... B65D 5/5021 D9/756
2003/0217944 A1* 11/2003 Belloli ..... B65B 21/242 206/443
2014/0312109 A1* 10/2014 Weston ..... B65D 5/6655 229/120.08

* cited by examiner

*Primary Examiner* — Luan K Bui
(74) *Attorney, Agent, or Firm* — SMITH, GAMBRELL & RUSSELL, LLP.

(57) ABSTRACT

A multiple-panel system present in a chamber of a reed container secures and orders one or more woodwind reeds in a base to tip arrangement. The chamber has a length and width dimension to hold one or more woodwind reeds. The multiple panel system includes a cover and at least two parallel panels with aligned openings that position individual reed. One opening is shaped to accommodate the reed base and the other opening is U-shaped to receive the mid-section of reed, when the reed is introduced trough the container opening. The width of U-shaped opening impedes lateral movement of the aligned reed through contact with the mid-section of the reed. This contact avoids reed tip contact with a wall during transport.

9 Claims, 6 Drawing Sheets

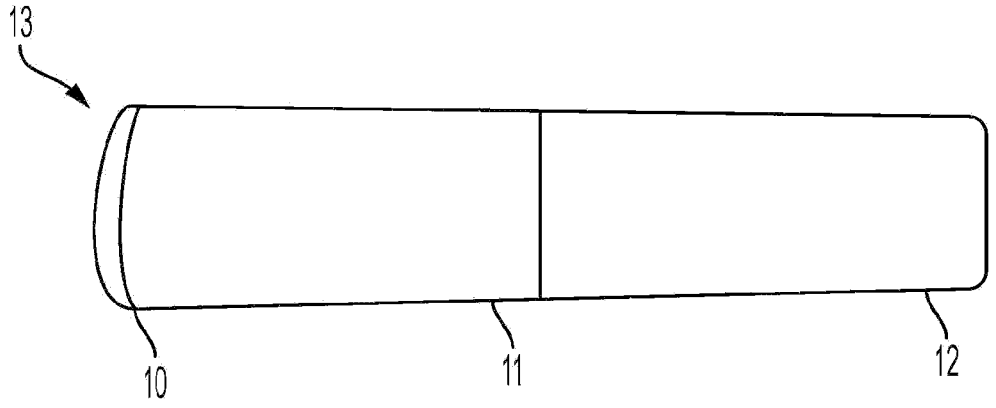
FIG. 3c
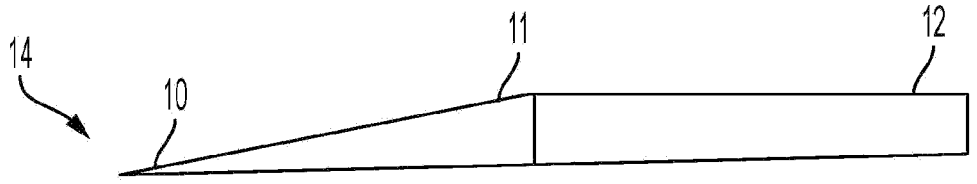
FIG. 3a
FIG. 3d
FIG. 3b
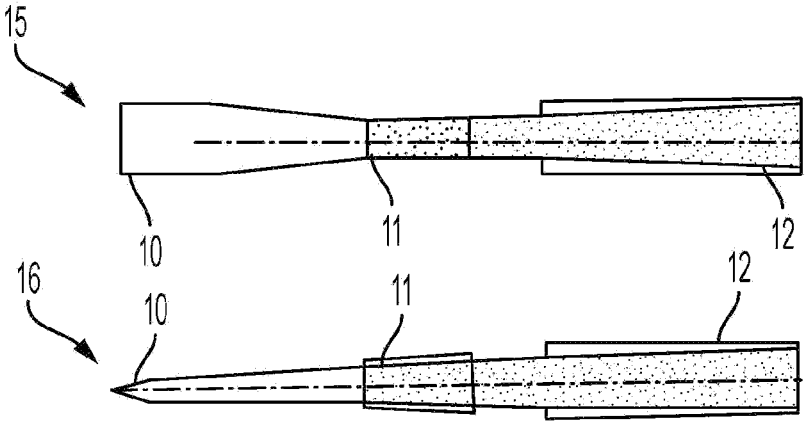

CASE INSERT TO SECURE WOODWIND REEDS

FIELD OF THE INVENTION

The present invention relates generally to a woodwind reed container and more particularly, to a multi-panel system present in a rectangular chamber within the container to facilitate storage and handling of woodwind reeds that minimizes or avoids reed damage during transport.

BACKGROUND OF THE INVENTION

Woodwind reeds are removable and interchangeable pieces of a woodwind instrument. Musicians choose between a selection of woodwind reeds before attaching their chosen reed to their instrument. These reeds include both single, e.g. clarinet and double reeds, e.g. oboe. These reeds require containers that allows the musician to have quick, easy, repetitive access to the reeds and allows for organization and lightweight, portable storage as the musician travels between performance locations. Woodwind reeds are made using a natural or synthetic cane. The different types of woodwind reeds have in common a tip that is fragile but include a variety of defining shapes unique to their single or double reed nature. The tip of every woodwind reed has specific measurements in micrometers that optimize a reed's vibration and sound production. The tip is extremely delicate. Of all the woodwind reed parts, the tip requires the greatest protection and any damage will cause failure of the entire woodwind instrument's functionality. Musicians and storage containers, therefore, mostly interact with the reed's base and sides during storage and transport.

Previous woodwind reed storage systems secure the reed within a container at specific locations by applying pressure at specific locations on the reed, e.g. by a clamp, or restrain reed movement by simultaneously contacting the reed at multiple points of contact, e.g. using a foam. Removal of the reed from the container requires relaxing the clamp or deforming the foam to free the confined reed.

Unfortunately, these modes of reed confinement limit all reed movement. A degree of movement would facilitate the ease of reed selection and removal. In addition, the prior art containers do not address accidental reed spillage resulting from a container being bumped or dropped from premature opening of the container.

Typical prior art devices that exemplify the general and specific modes of confinement includes devices such as those described in U.S. Pat. No. 4,674,630 (a device that maintains the reed in position using a reed spring) and U.S. Pat. No. 10,460,706 (a device that employs a sponge structure, reed holders and wicking action to maintain solution contact).

SUMMARY OF THE INVENTION

The present invention offers secure reed storage along with ease of reed placement, removal and return. The woodwind reed storage system of the invention removes the necessity of a constant force on the reed to maintain a single protected position for a reed within the case. A woodwind reed remains protected even as it shifts within its stored position as the container moves during regular use. In addition, the planned movement of the reed within the storage container accounts for any unplanned movement of the container, including accidental drops or bumps. The system of reed storage within a container of the invention differs from other systems of woodwind reed storage in that reed movement is permitted but controlled to avoid tip contact with a wall or the likelihood of spillage caused by random acts. The necessary control is provided by a multiple panel system present in the chamber. Two panels are parallel to each other and contain openings that are aligned, providing a supporting surface for holding an individual reed. The supported reed is capable of lateral movement that is parallel to side walls that define a chamber along with connecting walls between the sidewalls.

The opening of the first panel has a shape that allows the reed base to pass through it. The opening of the second panel is U-shaped providing an opening on an edge of the panel closest to the container opening. The opening receives the midsection of the reed, when the base is placed through the first panel opening. This U-shaped opening supports the reed at a position between the base and the tip. The third component of the panel system closes the U-shaped opening, physically or functionally when the container opening is closed by a cover. The closure of the opening is by physical contact of the cover with the second panel or a functional closure of the opening by a third panel that is attached to the cover. The functional closure is achieved by the edge of the third being in close proximity to the midsection of the reed. The functional closure limits the upward movement of the midsection of the reed to the space within the U-shaped opening. The placement of the third panel on the container cover positions the third panel so that it extends into the chamber space defined by first two parallel panels or is in close proximity of the second panel so that the midsection of the reed remains within the space defined by the U-shaped opening. The closeness of the extended edge of the third panel to the mid-section of the has the same effect of closing the U-shaped opening for the purposes of the invention. The upwards movement of the reed being held within the openings of both parallel panels without direct physical contact.

The chamber can be contained within the container or be the walls of the container. The chamber is roughly rectangular and accommodates one or more reeds in a single layer in a side by side arrangement—reed base to tip. The chamber contains two side walls and two walls that connect the side walls. The chamber walls define a container opening that permits reed placement or removal from the chamber. The opening can be closed by a removable cover that is secured to the container surface. The manner of securing the cover to the container is not critical, e.g. frictional fit, hinge and latch, etc. The parallel panels are also parallel to the connecting walls.

The opening of the first of the two panels is shaped to accommodate the reed base. This opening can be roughly circular or rectangular so long as the reed base can pass through it. The opening of the second panel is U-shaped. This allows the reed to be placed within it once the base is placed in the first opening. The U-shaped opening simply receives the middle section of the reed in a single motion when the reed base is placed within the opening in the first panel. The openings in the first and second panels contact the reed but permit lateral movement of the reed in the direction of the connecting walls. Placing or removing the reed from the container requires intentional acts: a first motion where the reed base is introduced through the container opening and through the first panel opening. The reed mid-section is then placed in the U-shaped opening of the second panel. To remove the reed from container, the motions are reversed.

The reed held in the panel openings can move laterally through the openings towards the connecting walls with the following caveat. The upwards motion of the reed is confined to the space defined by the U-shaped opening during transport by either the physical closure of the U-shaped opening by the closed cover or the equally effective functional closure of the U-shaped opening provided by the close proximity of the edge of extended third panel, when the container opening is closed by the cover during transport.

The width of the U-shaped opening impedes the lateral direction of reed movement due to the contact of the mid-section of the reed with the surface of the U-shaped opening. The width is selected so that lateral movement of the reed is impeded so that contact of the reed tip with the connecting wall is avoided. The shape and dimensions of the reed are considered relative to the width measurement so that tip damage caused by the contact with the connecting wall is avoided.

Another object of the invention is to minimize the possibility of reed spillage due to serendipity caused by accidental opening of the container. The structure of the panel system minimizes the possibility of the duplication of the intentional acts required for removal of the reeds from the chamber due to elements of the single or double reed structures and the panel openings of varied shape and alignment. The panel structure requires specified acts performed in a specified order in placing or removing the reeds from the chamber.

Due to its simplicity of the three-panel system, the system costs less to manufacture while retaining or improving upon storage properties critical to the protection of woodwind reeds, such as proper airflow around the reed, separation between the reed tip and the container, easy removal of reeds without damage to the reed tip, and decreased likelihood of reeds spilling out when the reed container is opened or dropped. The panel assembly design can be manufactured using any rigid material and can be used with containers having internal dimensions greater than those of a standard woodwind reed. The panel design accommodates the securing of a single or multiple woodwind reeds. The flexibility in material type and the absence of moving parts keeps my reed case compact, lightweight, travel ready, and low-cost. The general design of the panel assembly is adaptable to different woodwind reed types, e.g. oboe, clarinet, etc.

BRIEF DESCRIPTION OF THE DRAWINGS

The preferred embodiments of the invention are described in conjunction with the appended figures. The figures are provided to illustrate but not limit the invention.

FIGS. 1*a* and *b* (paper origami) show the embodiment where the multi-panel system includes a cover and two-parallel panels. FIGS. 1*c* and *d* (wood) and 1*e* and *f* (acrylic) show a multi-panel system with two parallel panels and a third panel attached to the cover.

FIG. 3*a, c* show a single reed, e.g. clarinet, and FIG. 3*b,d* show a double reed, e.g. oboe. Both reeds are shown with a front (FIG. 3*c*; FIG. 3*d*) and side view (FIG. 3*a*; FIG. 3*b*) of their elongated side. Both reeds evidence a taper.

DETAILED DESCRIPTION OF THE INVENTION

The following description is exemplary in nature and is not intended to limit the described embodiments or the application and uses of the described embodiments.

Reed Container

Woodwind reeds come in a variety of shapes and sizes. The shapes are standardized and can form a basis for container design. The design of the container utilizes the dimensional differences in the reed base, tip and reed portion between the two to develop a panel system to order the reeds within a reed container.

Figure 1A:
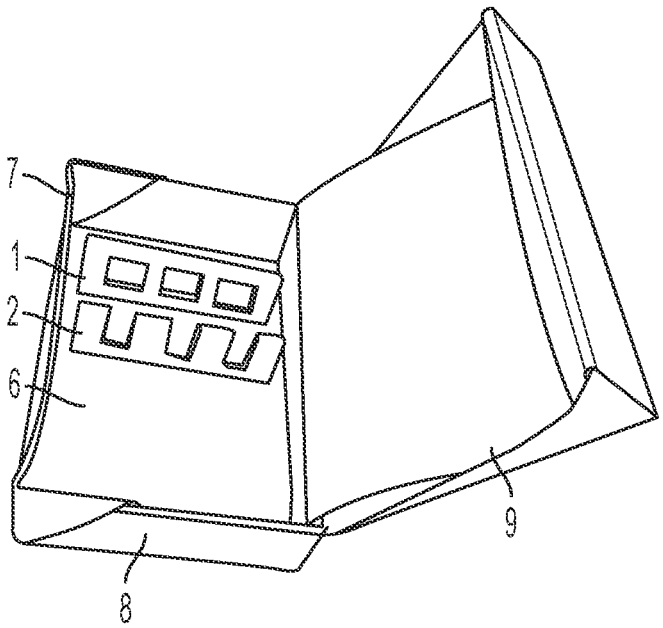
FIGS. 1*a*-1*f* show photographs of reed case prototypes. Depicted is a double reed, e.g. oboe.
Figure 1B:
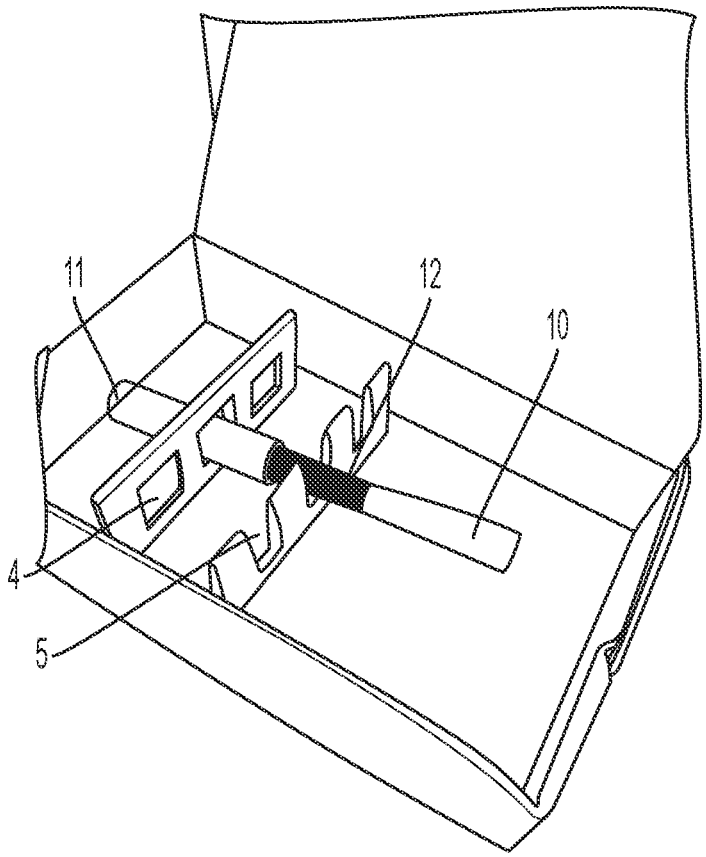
Figure 1C:
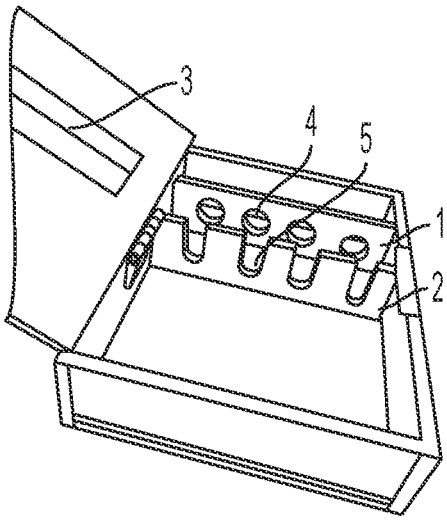
Figure 1D:
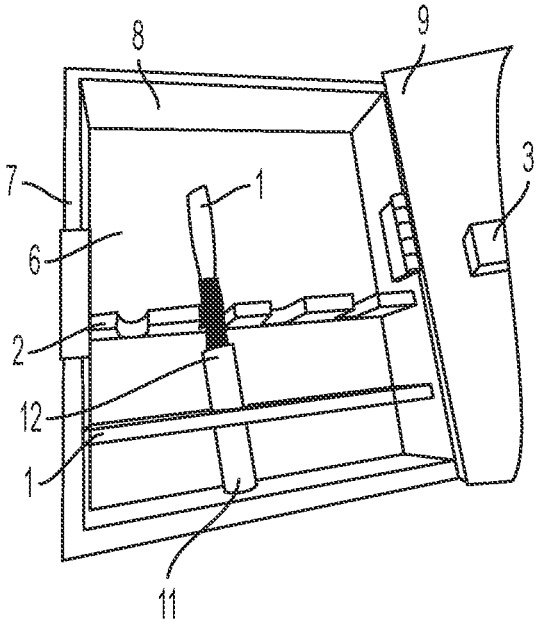
Figure 1E:
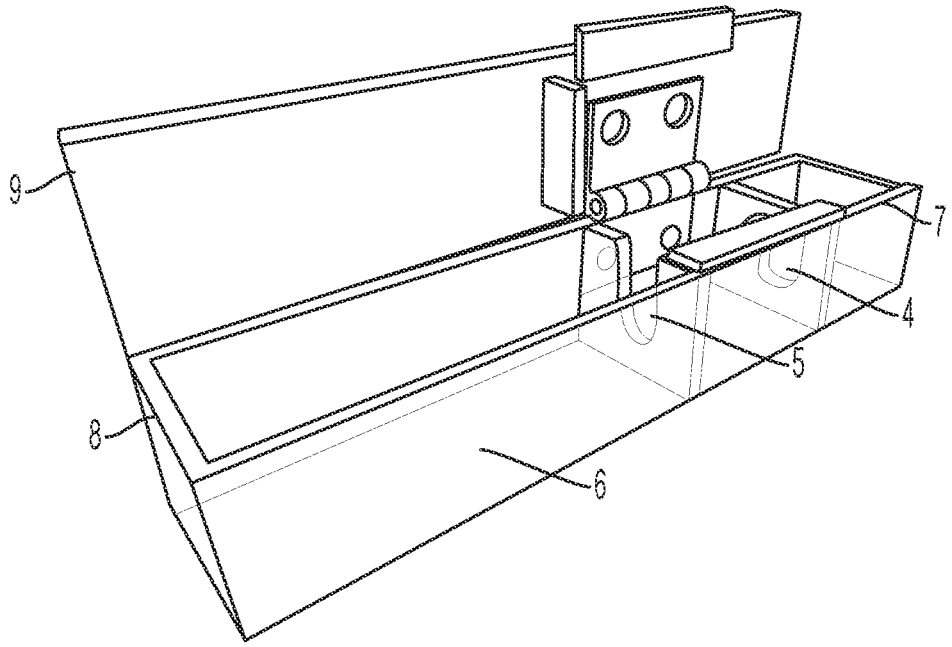
Figure 1F:
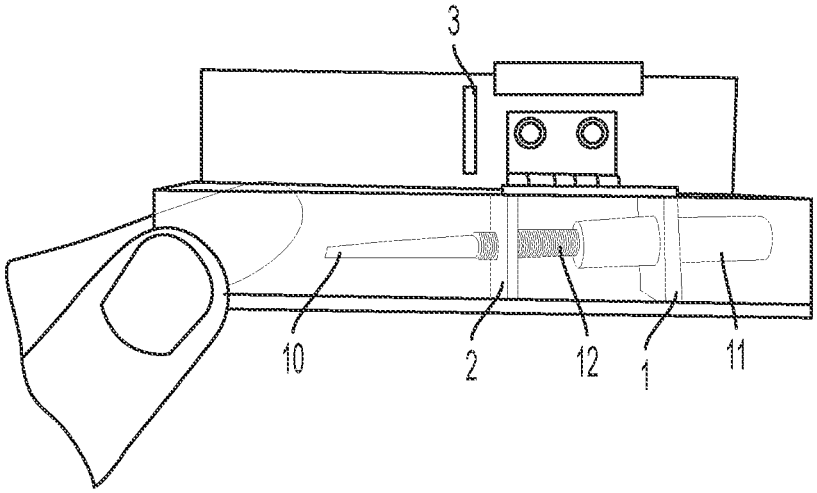

FIGS. 1*a* and *b* show the embodiment where the multi-panel system includes a cover and two-parallel panels. FIGS. 1*c, d, e*, and *f* show a multi-panel system (wood) with two parallel panels and a third panel attached to the cover.

Figure 4A:
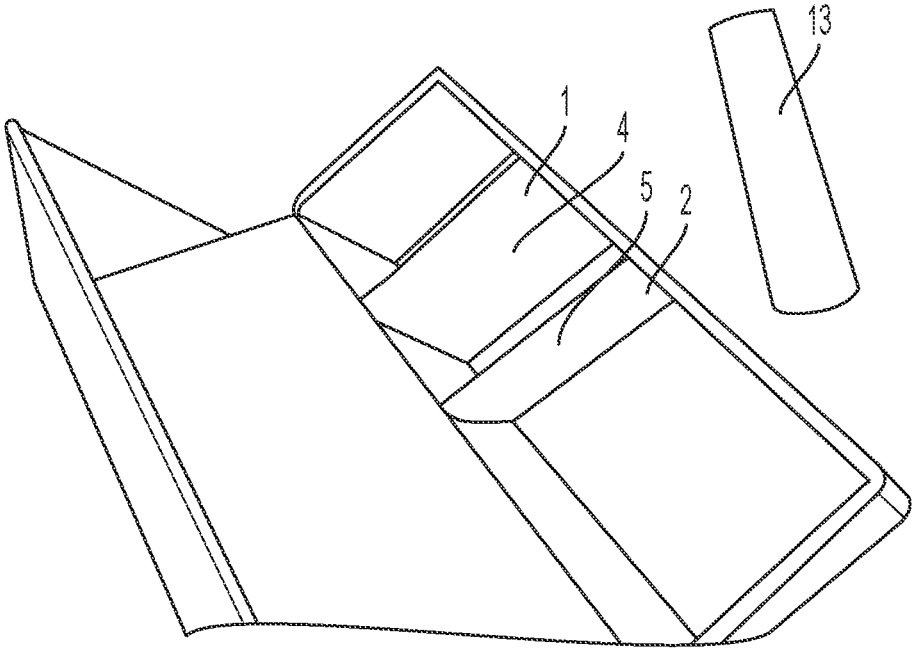
FIG. 4*a* shows a single reed and a container with a panel system adapted for handling a single reed.
Figure 4B:
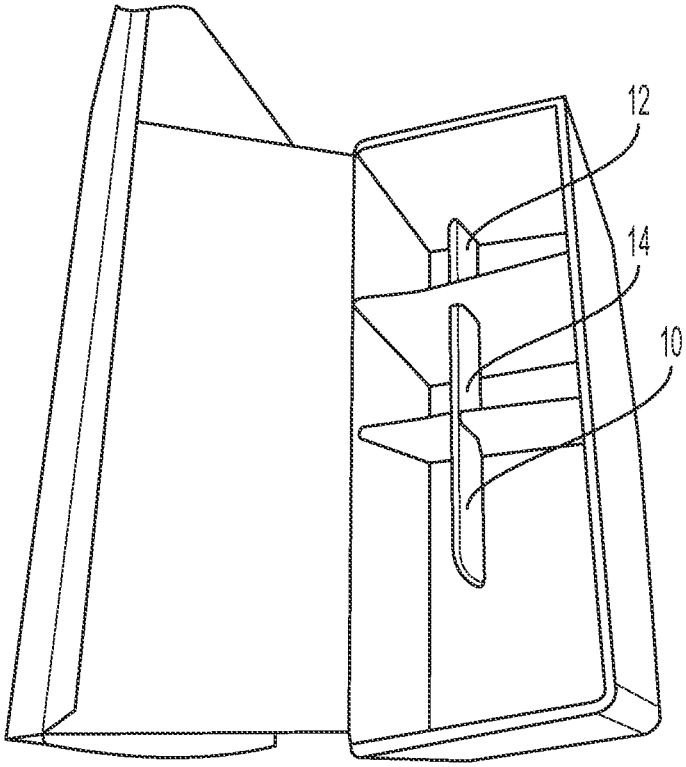
FIG. 4*b* shows the placement of the panel system within the chamber with the single reed positioned within a rectangular opening within the first panel and a U-shaped opening in the second. The container cover closes the U-shaped opening.

FIG. 4*a* (reed and container) and b (reed positioned within container) show the container (6) showing a single reed container (6) where the cover closes the U-shaped opening of the second panel and adapted for a single reed, e.g. clarinete reed.

The reed container (6) for transporting woodwind reeds (14) include a chamber defined by sidewalls (7) and walls connecting (8) the side walls. The container opening is defined by the connecting and side walls of the chamber that extend with the container surface (6). The multiple panel system is contained within the chamber and a cover (9). The cover (9) is of sufficient size to close the container opening. The cover (9) contacts with the multi-panel system upon closure, thereby effectively closing the U-shaped opening (5) present on a second panel (2) of the multiple panel system.

The panel system includes at least a first (1) and second (2) panel positioned in parallel, where the first panel (1) includes an opening (4) that receives the reed base (11) and the second panel (2) includes an U-shaped structure (5), which receives the middle of the reed (12), the opening on the first panel (4) and the U-shaped (5) opening are aligned and hold an individual reed (14) when present at no more than two points of contact, where the aligned reed can move in a lateral direction toward a connecting wall with the lateral motion limited by contact of the width of the reed at the mid-portion with the surface of the U-shaped opening (5) so that contact with the connecting wall (8) is avoided during transport. The shape of the opening (4) of the first container is selected to facilitate the reed base placement based on reed type—roughly circular or rectangular. A double reed (14*a*), e.g. oboe, may be better suited for a circular opening, where a single reed (14*b*), e.g. clarinet, may be better suited for placement within a rectangular opening.

The aligned openings of the first (1) and second (2) panels provide two points of contact. The panel assembly provides reed contact possibility to those offered by the cover (9) or the third panel (3) attached thereto and the aligned openings. During transport, the reed (14) is supported, confined by at least two contacting surfaces. The aligned openings ensure that when multiple reeds are present in a single horizontal layer. This layer ensures a proper functioning of the system when multiple reeds are present.

FIGS. 4*a* and *b* show the container where the opening of the first panel is positioned to hold a single reed with a flat surface with a width that extends toward the opening and the cover 9) closes the U-shaped opening of the second panel (2).

Reeds

The reed types suitable for transport using the container of the invention include both single and double reeds. These reed types are shown in FIGS. 3*a* and *b* respectively. The measurements and reed shape are a consideration in selecting an appropriate width for the U-shaped opening of the second panel.

Starting with the base clarinet reed (3*a*), 10=1 mm, 11=2 mm, 12=3 mm. #12 of perspective 13, or the base width, is 12 mm This makes first panel opening (4) range between 12-15 mm in height and 3-5 mm in width for a clarinet reed. The second panel opening (5) would range between 1-2 mm wide and be at least 13 mm deep (as the U-shaped opening). The reed measurements are pretty standard but the clarinet family of reeds ranges in size from the smallest clarinet reed to the largest bari saxophone reed. These single reeds all look identical without a size reference though.

For FIG. 3*b,* 10=1 mm, 11=4 mm, 12=7 mm. So for an oboe reed, the first panel opening would be 7-10 mm square or circle and the second opening would be 3-7 mm wide and at least 8 mm deep for the U-shaped opening. The double reeds like oboe and bassoon also range in size but don't look identical. They are all conical and hollow, though. So as the measurements of the reeds go up in size so do the size of the panel openings.

Ultimately, the function of the U-shaped opening (5) is a brake to prevent the reed tip (10) from contacting the connecting wall and would depend on additional factors including the dimension of the container.

Oboe Reeds

The reed where exemplified in the figures is an oboe reed.

Figure 2A:
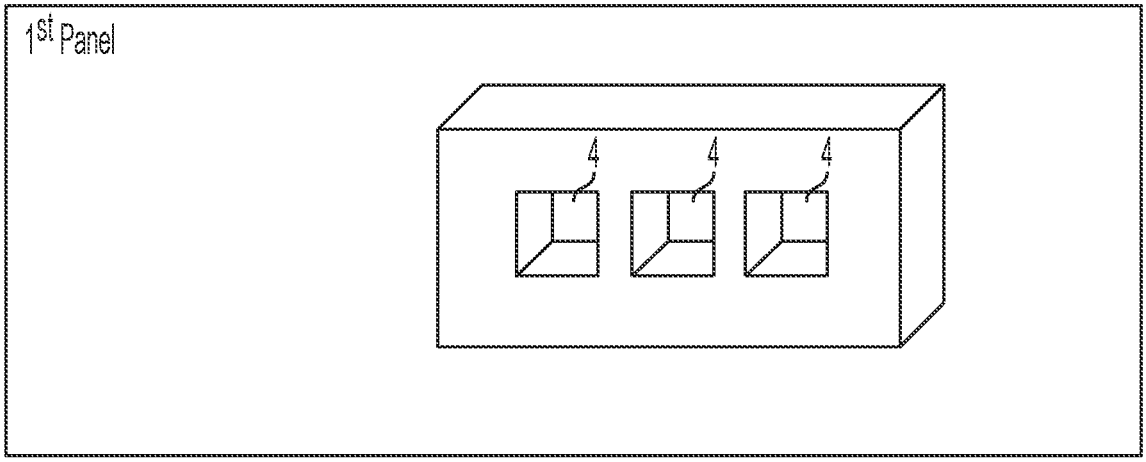
FIGS. 2*a*-2*c* show a perspective view of the individual panels—a first panel (Panel A) (FIG. 2*a*), a second panel (Panel B) (FIG. 2*b*) and a third panel (Panel C) (FIG. 2*c*).
Figure 2B:
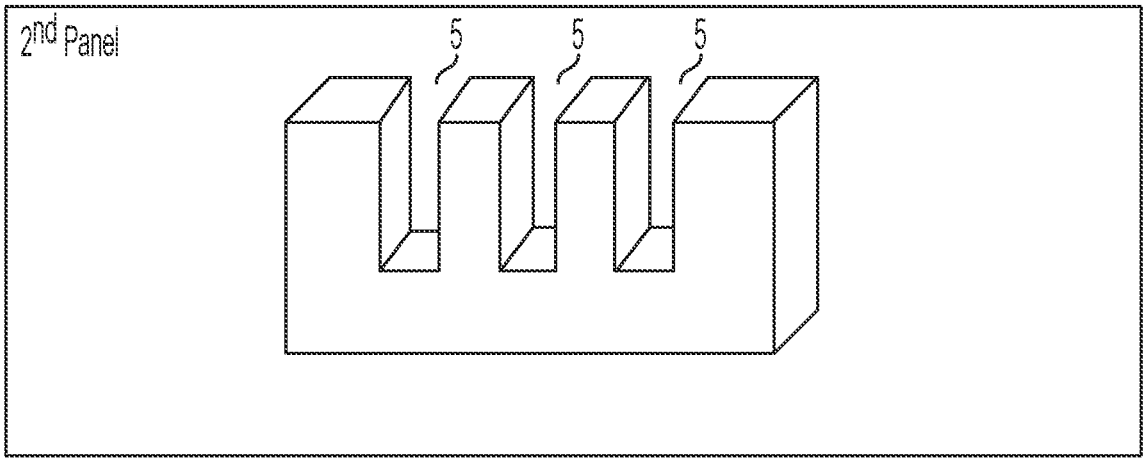
Figure 2C:
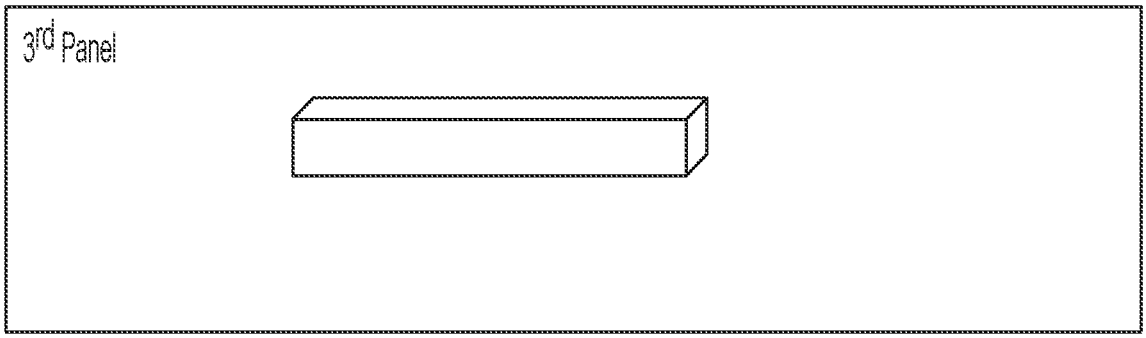

FIGS. 2*a*-2*c* show a perspective view of the individual panels—a first panel (1), a second panel (2), and a third panel (3).

The oboe reed container has a length greater than those of a standard oboe reed. An opening (4), with measurements greater than the largest external diameter of a standard oboe reed but less than the measurements of the panel, is centered on a first panel (1). A second panel (2), positioned closer to the reed terminus, has an opening sized between the external diameter of the cork on a standard oboe staple and the external diameter of the string-wrapped part of a standard oboe staple, and a length greater than the opening (4) on the first panel (1) and extending to the top edge of the second panel B (2). The distance between the lowest point of the opening on the first panel (4) and the bottom edge of the first panel (1) is equal to the distance between the lowest point of the opening on the second panel (5) and the bottom edge of the second panel (2). This distance is also greater than half the width of a standard oboe reed and correlates to the height of the third Panel (3).

The second panel B (2) is placed vertically within a container and within 47 mm from a connecting wall (8) of the container. The first panel (1) is placed vertically and between the second panel (2) and the same wall previously mentioned. The center, vertical axis of the opening on the first panel (4) will approximately line up with the center, vertical axis of the opening on the second panel (5). The third panel (3) is placed on the cover (9) of the container at a point that lines up between the first panel (1) and the second panel (2).

The invention reflects a design concept that improves attributes of oboe reed containers. Since many modifications, variations and changes in detail can be made to the described preferred embodiments of the invention, it is intended that all matters in the foregoing description and sown in the figures be interpreted as illustrative and not in a limiting sense.

Method-Transport and Storage

Certain advantages of the container relative to transport, e.g. avoiding reed tip damage and accidental reed spillage, result from the multi-panel system. The advantages are present during transport but are also present when the container is open.

The panel system is unique relative to reed access. The panel system is in contact directly or indirectly with the cover that closes the opening for accessing the reeds when the reeds are stored in the container or in transport.

Access includes placing or removing a reed from a panel system where placing the reed includes orienting the reed base through the container opening and into the confines of the opening of the first panel and lowering a portion of the reed between the base and tip into the U-shaped opening of the second panel and where removing the reed involves lifting the portion of the reed between the base and tip from the U-shaped opening, removing the base from the opening in the first panel and withdrawing the reed through the container opening.

The contact of the cover with the panel system in the chamber can result from the closure of the opening so that the cover is in direct contact with the opening of the U-shaped opening of second panel. This physically closes the opening of the U-shaped opening of the second panel. Reed motion is limited in both at upward motion within the confines of the U-shaped opening and laterally in the direction of the connecting wall so that damage to the reed tip is avoided.

The contact of the cover with the panel system can also occur through the presence of a third panel attached to the cover. The third panel is positioned on the cover so that when the cover is closed over the container opening, the third panel is inserted into the space between the first and second parallel panels. The third panel is inserted so that it is in close proximity the portion of the reed between the base and tip. This limits the upward reed movement in the direction of the opening of the U-shaped opening. This also functionally closes the opening of the U-shaped opening of the second panel due to restraints place on reed movement. Lateral reed movement in the direction of the connecting wall is also restricted.

Although the invention herein has been described with reference to particular embodiments, it is to be understood that these embodiments are merely illustrative of the principals and applications of the present invention. Accordingly, while the invention has been described with reference to the structures and processes disclosed, it is not confined to the details set forth, but is intended to cover such modifications or changes as may fall within the scope of the following claims.

DRAWING ELEMENTS

First Panel (1)
Second Panel (2)
Third Panel (3)
First Panel Opening (4)
Second Panel U-Shaped Opening (5)
Container (6)
Sidewalls (7)
Connecting Wall (8)
Cover (9)

Woodwind Reed Tip (10)
Woodwind Reed Base (11)
Woodwind Reed Middle (12)
Woodwind Single Reeds Front View (13)
Woodwind Single Reeds, Side View (14)
Woodwind Double Reeds Front View (15)
Woodwind Double Reeds Side View (16)

What is claimed is:

1. A reed container for transporting woodwind reeds, having a base, a mid-section and a tip, comprising, a chamber for holding the reeds has two parallel sidewalls and two walls that are perpendicular to and contact each sidewall, a container opening defined by the two side walls and the two walls that connect the sidewalls, a multiple panel system, within the chamber, that includes at least two parallel panels that hold each reed in a base to tip arrangement, and a cover of sufficient size to close the container opening and is in contact with the multiple panel system upon closure, where a first panel of the multiple panel system includes an opening that receives the reed base and a second panel of the multiple panel system includes an U-shaped opening, which receives the mid-section of the reed, the opening on the first panel and the U-shaped opening on the second panel are aligned and support the reed at no more than two points of contact, and where contact of the reed tip with a wall that connects the sidewalls is avoided by the U-shaped opening on the second panel, which has a width less than the opening on the first panel and wherein the multiple panel system includes a panel attached to the cover, which, when the container opening is closed, is positioned between the first and second panels and in close proximity to the mid-portion of the reed, when present, thereby confining reed movement to be within the U-shaped opening.

2. The reed container of claim 1 wherein the opening of the first panel is circular.

3. The reed container of claim 1 wherein the opening of the first panel is rectangular.

4. The reed container of claim 1 wherein the first panel and the second panel have multiple aligned openings for holding multiple reeds in a single layer.

5. The reed container of claim 4 wherein the layer is horizontal to the cover, when closed.

6. The reed container of claim 1 wherein the container has a rectangular shape.

7. The reed container of claim 1 wherein the reed is a cylindrical reed.

8. The reed container of claim 1 wherein the reed is a flat reed.

9. The reed container of claim 1 comprises material selected from wood, paper, or acrylic.

* * * * *